US006224953B1

(12) United States Patent
Johnson

(10) Patent No.: US 6,224,953 B1
(45) Date of Patent: May 1, 2001

(54) ARTIFICIAL PALM TREE

(76) Inventor: Alfred E. Johnson, 23 E. 1100 North, Orem, UT (US) 84057

( * ) Notice: Subject to any disclaimer, the term of this patent is extended or adjusted under 35 U.S.C. 154(b) by 0 days.

(21) Appl. No.: 09/336,262

(22) Filed: Jun. 18, 1999

(51) Int. Cl.[7] ..... H41G 1/00

(52) U.S. Cl. ..... 428/20; 428/22; 428/27

(58) Field of Search ..... 428/18, 20, 19, 428/17, 22, 23, 27; 156/61, 191; 362/123

(56) References Cited

U.S. PATENT DOCUMENTS

| | | | |
|---|---|---|---|
| 2,080,523 | | 5/1937 | Williams et al. . |
| 2,085,900 | * | 2/1992 | Hamlett . |
| 2,251,705 | | 8/1941 | Gonzalez . |
| 2,251,706 | | 8/1941 | Loewy . |
| 5,787,649 | * | 8/1998 | Popowych et al. . |

FOREIGN PATENT DOCUMENTS

| | | | |
|---|---|---|---|
| 186750 | * | 9/1936 | (CH) . |
| 2923280 | * | 12/1980 | (DE) . |
| 2944931 | * | 6/1981 | (DE) . |

* cited by examiner

*Primary Examiner*—Deborah Jones
*Assistant Examiner*—Wendy Boss
(74) *Attorney, Agent, or Firm*—Angus C. Fox, III

(57) ABSTRACT

An artificial palm tree has a trunk made from at least one tapered pole segment. Multiple trunk segments are butt connected with doweling screws threaded at both ends. A palm head in the form of a cylindrical solid is attached to an uppermost end of the uppermost segment of the trunk in the same manner as abutting segments of the trunk are attached to one another. A plurality of frond attachment holes are bored in the head. Each attachment hole is sized to accept a removable wood dowel pin. Each dowel pin, when inserted within its receiving hole, is angled to approximate the position of a frond on the trunk. Prior to assembly, each trunk segment and the palm head are individually wrapped with a layer of palm matting harvested from live palm trees. The matting layer is either stapled or adhesively bonded to the wrapped trunk segments and head. Wrapping of the palm head is performed with the dowel pins inserted within the frond attachment holes so that the dowel pins may serve to mark the location of the holes. Artificial and dried palm fronds obtained from a variety of sources may be affixed to the palm head. As each dowel pin is successively removed from the head, a frond is inserted in its place. Once all dowel pins have been replaced with fronds the palm head is attached to the assembled trunk. Alternatively, the fronds may be attached to the palm head after it is attached to the trunk. For another embodiment of the invention, each of the dowel pins becomes part of the assembled tree, being axially drilled to receive the attachment end of a high-tensile steel wire which serves as the central rib of a particular type of commercially-available frond. One or more artificial palm trees manufactured in accordance with the present invention are anchored to a steel fabricated from a base member, at least one upright right-angle support bracket to which a lowermost trunk segment is strapped, and an alignment pin associated with each bracket which fits into an alignment hole bored in the base of the lowermost trunk segment.

19 Claims, 4 Drawing Sheets

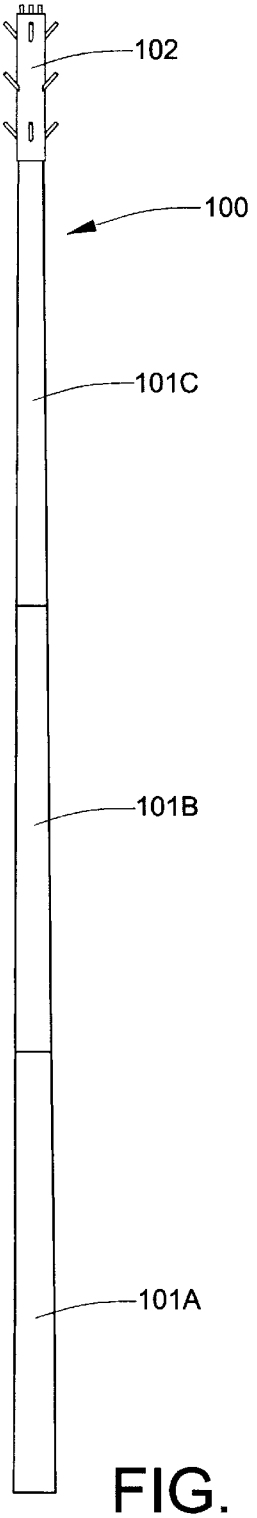
FIG. 1
FIG. 2
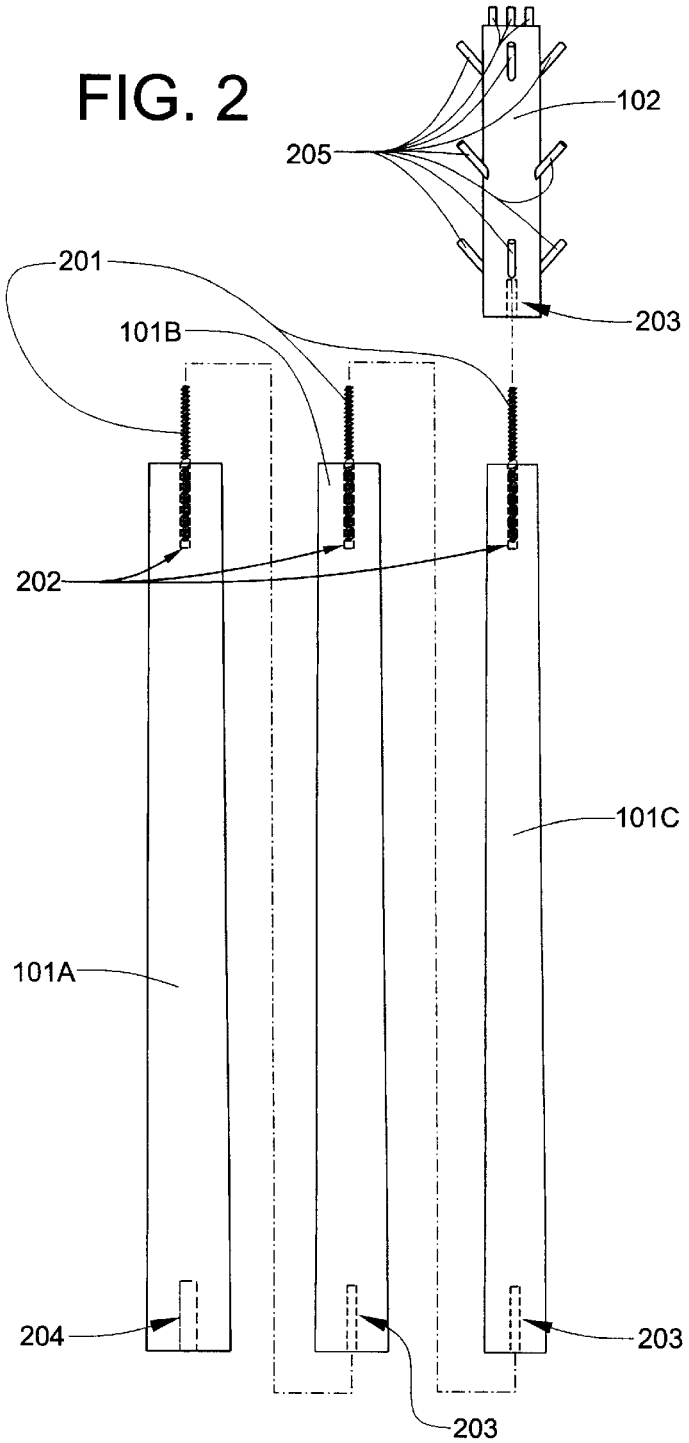

ARTIFICIAL PALM TREE

This application is related to application Ser. No. 09/336,261, which was filed on Jun. 18,1999 and is titled METHOD OF MAKING AN ARTIFICIAL PALM TREE.

BACKGROUND OF THE INVENTION

1. Field of the Invention

This invention relates generally to artificial trees and plants and, more particularly, to artificial palm trees and methods for manufacturing the same.

2. History of the Prior Art

Artificial trees and plants are used extensively for decorating the interiors of homes and commercial buildings. Artificial palm trees are very popular with interior decorators. In fact, at least one artificial palm tree has been designed for exterior use. That tree, which is described in U.S. Pat. No. 5,085,900, features a fiberglass-reinforced plastic trunk having a frond-attachment cap at the upper end, fronds constructed from a high-tensile steel wire and artificial leaves spaced along the wire and secured thereto with all-weather tape. The fronds are attachable to the cap by means of ferrules embedded within the cap, and the trunk is securable to a rod embedded and anchored in the ground which fits within an axial bore in the base of the trunk.

In spite of the popularity of artificial palm trees, ultra-realistic-appearing artificial palm trees are difficult to manufacture and, if large, difficult to transport. Typically, the trunks are made of plastic reinforced with a central steel pipe. Palm matting has heretofore been adhesively bonded to portions of the trunks. In addition, if the frond attachment head is wrapped with palm matting, inserting fronds into frond attachment apertures in the head can be a frustrating and time-consuming experience. The availability of fronds having different sized central ribs also complicates the assembly process. The ribs are usually formed from a length of high-tensile steel wire. The attachment end may be bare or covered with a layer of plastic. Finally because of the top-heavy nature of palm trees, a secure base is required for mounting the trunk. If realism is to be maintained, the base must be as inconspicuous as possible.

What is needed is a realistic-appearing artificial palm tree that is easily transported, easily assembled, securely mountable, and inexpensive to manufacture.

SUMMARY OF THE INVENTION

The present invention fills the heretofore enunciated need for a realistic-appearing artificial palm tree that is easily transported, easily assembled, securely mountable to a base, and inexpensive to manufacture. The invention also includes a method for manufacturing the aforesaid artificial palm tree. The tree includes a trunk made from at least one tapered pole segment. The poles are, preferably, trunks of pine trees from which the branches have been removed. In order to facilitate handling and assembling tall trees, the trunks may be segmented. The segments are affixed end-to-end during assembly. The end of one of two abutting segments is fitted with a double-ended doweling screw that is adhesively bonded within an axially-aligned hole in that segment. The end of the other abutting segment incorporates an axially-aligned cylindrical hole into which the free end of the doweling screw may be threadably inserted.

A palm head in the form of a cylindrical solid attached to the uppermost segment of the trunk in the same manner as abutting segments of the trunk are attached to one another.

A plurality of frond attachment holes are bored in the head. Each attachment hole is sized to accept a removable wood dowel pin, each dowel pin, when inserted within its receiving hole, being angled to approximate the position of a frond on the trunk. Prior to assembly, each trunk segment and the palm head are individually wrapped with a layer of palm matting harvested from live palm trees. The harvesting process, incidentally, does not kill the trees. The matting layer is either stapled or adhesively bonded to the wrapped trunk segments and head, with stapling being the preferred attachment method. Wrapping of the palm head is performed with the dowel pins inserted within the frond attachment holes so that the dowel pins may serve to mark the location of the holes. If the head is wrapped with matting without first having the dowel pins positioned within the attachment holes, the holes become covered with the matting layer, making them difficult to locate during the frond attachment step. The use of a probe to locate the covered holes may damage the palm matting layer. Likewise, if the frond attachment holes are drilled into the head body through the palm matting, unsightly damage to the palm matting can easily occur.

Artificial palm trees that are sufficiently small that the trunks and head need not be disassemblable, may be fabricated from a single pole which serves as both the trunk and the head. During the manufacturing process, the head portion is drilled to receive the frond attachment plugs, the trunk and head portions are wrapped with palm matting, and the attachment plugs are replaced by artificial fronds, one at a time.

Artificial palm fronds obtained from a variety of commercially-available sources are affixed to the palm head. As each dowel pin is successively removed from the head, a frond is inserted in its place. Once all dowel pins have been replaced with fronds the palm head is attached to the assembled trunk. Alternatively, the fronds may be attached to the palm head after it is attached to the trunk.

For an alternative embodiment of the invention, each of the dowel pins is axially drilled to receive a palm frond. The drilled dowel pins, which will become part of the permanent structure, may also be partly covered with a layer of peat moss or partly wrapped with a layer of palm matting in order to promote a more realistic appearance. Commercially-available fronds generally have a high-tensile steel wire for a central rib which may be either bare or covered with a layer of plastic. The plastic covered ribs are generally of a larger diameter than the bare wire ribs. In order to accommodate both types of ribs, the attachment end of the bare ribs can be inserted into the axially drilled hole in the dowel pin which remains a permanent part of the assembled tree, or the dowel pin can be removed to accept the larger diameter ribs. The drilled dowel pins afford greater flexibility with regard to which artificial fronds may be used in the manufacture of the artificial palm trees.

One or more artificial palm trees manufactured in accordance with the present invention may be anchored to a stand constructed from a strong and inexpensive metal or metal alloy. Steel is the preferred metal alloy due to its inherent strength and low cost. The stand is fabricated from a base member, at least one upright right-angle brace to which a lowermost trunk segment is strapped, and an alignment pin associated with each brace which fits into an alignment hole bored in the base of the lowermost trunk segment. The axis of the alignment hole may coincide with the axis of the lowermost trunk segment, or it may be parallel to the trunk segment axis. The base may be fabricated from plate steel, or it may be fabricated from welded rods in the interest of weight reduction.

BRIEF DESCRIPTION OF THE DRAWINGS

FIG. 1 is a side elevational view of an unwrapped assembled trunk and head of the new artificial palm tree;

FIG. 2 is an exploded view of the assembly of FIG. 1;

DETAILED DISCLOSURE OF THE INVENTION

Figure 3:
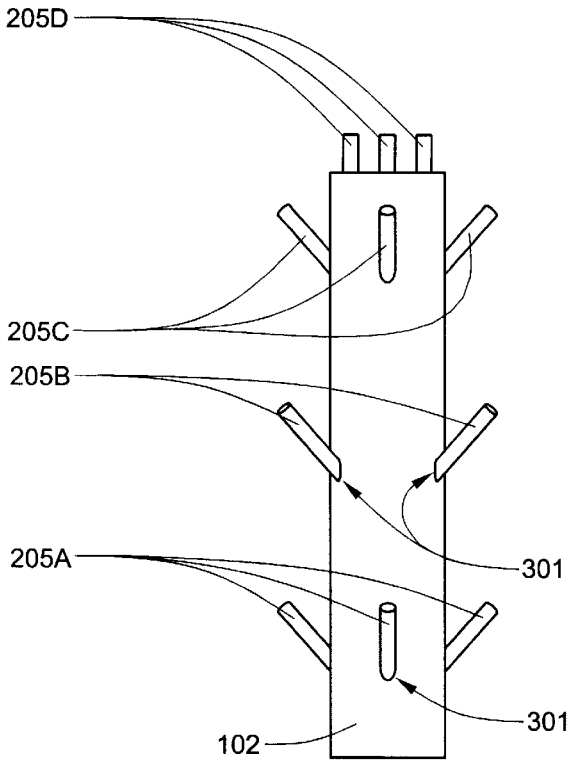
FIG. 3 is a close-up side elevational view of the unwrapped head of the assembly of FIG. 1.

The present invention encompasses a new realistic-appearing artificial palm tree that is easily transported, easily assembled, securely mountable to a base, and inexpensive to manufacture. The invention also includes a method for manufacturing the aforesaid artificial palm tree.

The new artificial palm tree includes a trunk made from at least one tapered pole. The poles are, preferably, trunks of pine trees from which the branches have been removed. The bark is preferably left in place in order to both minimize costs and provide a more textured surface, which enhances the realistic appearance. In order to facilitate handling and assembling tall trees, the trunks may be segmented. The segments are affixed end-to-end during assembly. A frond attachment head is either affixed to the upper-most pole segment or is incorporated in the upper-most end of a pole or pole segment. Referring now to FIG. 1, a palm tree skeleton 100, manufactured in accordance with the present invention, has a trunk assembled from three pole sections 101A, 101B and 101C and a frond attachment head 102 attached to the uppermost pole section 101C.

Referring now to FIG. 2, the palm tree skeleton 100 of FIG. 1 is shown disassembled. Each pole section 101A, 101B and 101C is fitted with a doweling screw 201 threaded at both ends that is permanently anchored within an axially-aligned anchoring hole 202. The end of the other abutting component, which in this case is either pole section 101B and 101C or frond attachment head 102, incorporates an axially-aligned cylindrical receiving hole 203 into which the free end of the doweling screw 201 may be threadably inserted. The doweling screw 201 may be permanently anchored within the hole 202 by either bonding it an adhesive such as epoxy, or by making hole 202 smaller in diameter than hole 203 so that it will unscrew from the latter instead of the former. It will be noted that the lowermost pole section 101A has an axially-aligned mounting hole 204 which fits over a mounting pin on a stand. The construction of the stand will be hereinafter described. Multiple dowel pins 205 project from the frond attachment head 102.

Referring now to FIG. 3, the frond attachment head 102 is fitted with multiple groups of three dowel pins 205A, 205B, 205C, and 205D. Each dowel pin 205 is inserted within a frond attachment hole 301 bored within the frond attachment head 102. A real palm tree grows by sprouting new fronds from the uppermost part of the tree simultaneously. Old fronds die and fall off the trunk. Thus, the three dowel pins 205D represent the positions of the newest fronds. The three dowel pins 205A represent the positions of the oldest remaining fronds. Two types of fronds are used to make artificial palm trees. The most common and least expensive are completely artificial, being fabricated from a central wire rib to which leaves made of polymer-coated silk are attached. The central ribs may be coated with plastic to enhance the appearance. Plastic coated ribs may have a diameter at the attachment end that is significantly greater than that of the uncoated ribs. This fact complicates the manufacturing process somewhat, as provision must be made for the different sized ribs. The most realistic fronds for artificial trees are fronds from living trees dried using a special process to preserve their life-like appearance. These dried fronds can cost as much as ten times that of fronds made from silk.

Figure 4:
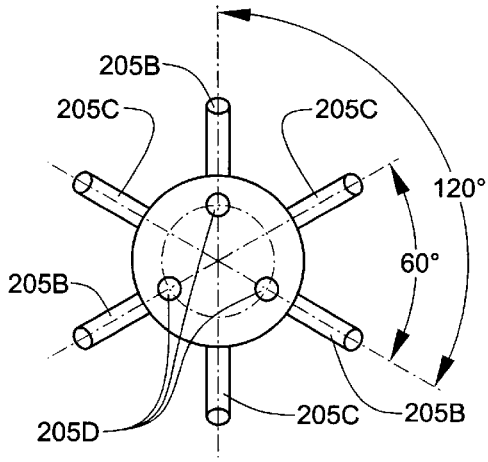
FIG. 4 is a top plan view of the unwrapped head of FIG. 3.

Referring now to FIG. 4, this top plan view shows the preferred spacing of the dowel pins. On a real palm tree, each new set of three fronds is offset about 60 degrees from the last sprouted set of fronds. Each frond within a set is spaced about 120 degrees from the other two.

Figure 5:
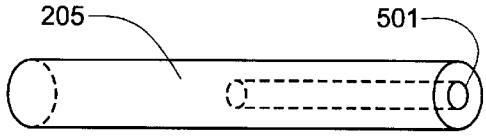
FIG. 5 is an isometric view of a frond plug.

Referring now to FIG. 5, a dowel pin 205 is axially drilled with a hole 501. Artificial fronds generally come in two types. Some have thick central ribs which are approximately the same diameter as the dowel pin 205, while others have thin ribs with approximately the same diameter as the hole 501 in dowel pin 205. Thus, the fronds with large diameter ribs may be used by removing the dowel pins 205 and inserting the attachment end of the rib within the frond attachment hole 301. Fronds having smaller diameter ribs may be used by inserting the attachment end of the rib within the dowel pin holes 501. In order to smooth the transition between a dowel pin 205 and the attachment end of a palm frond rib, the exposed end of each dowel pin 205 may be wrapped with a layer of palm matting. Alternatively, the exposed end of each dowel pin 205 may be covered with a layer of peat moss in order to camouflage it.

Figure 6:
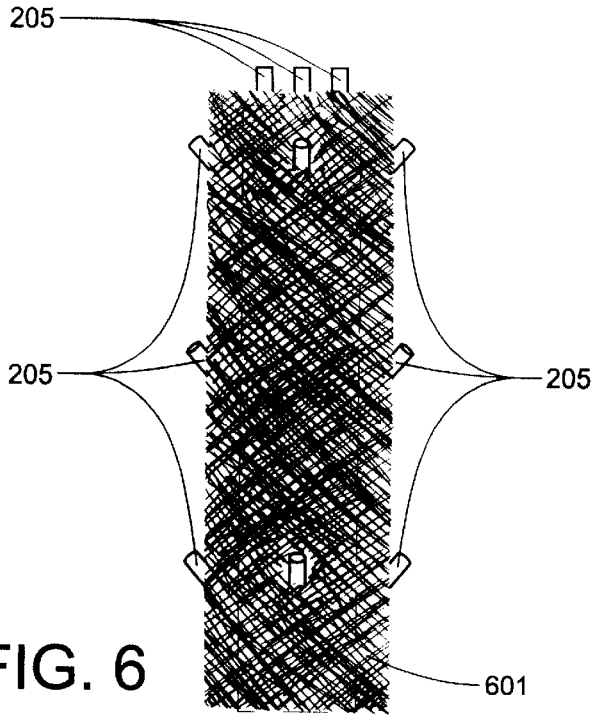
FIG. 6 is a side elevational view of the head of FIG. 3 after it has been wrapped with palm matting.

Referring now to FIG. 6, the frond attachment head, as well as the pole segments 101A, 101B, and 101C forming the trunk, are individually wrapped with palm matting 601, beginning with the top of the head or segment, prior to assembly so as to impart a realistic appearance to the finished product. The palm matting is harvested from live palm trees using a process that does not kill the trees. The palm matting layer 601 is either stapled or adhesively bonded to the wrapped trunk segments and head, with stapling being the preferred attachment method. If narrow staples or even larger staples colored to match the palm matting are used, they are virtually undetectable. Wrapping of the frond attachment head 102 with palm matting 601 is accomplished with the dowel pins 205 inserted within the frond attachment holes 301 so that the dowel pins 205 may serve to mark the location of the holes. If the head is wrapped with matting 601 without first having the dowel pins positioned within the frond attachment holes, the holes 301 become covered with the matting layer 601, making them difficult to locate during the frond attachment step. The use of a probe to locate the covered holes may damage the palm matting layer 601. Likewise, if the frond attachment holes are drilled into the head body through the palm matting, unsightly damage to the palm matting 601 can easily occur.

Figure 7:
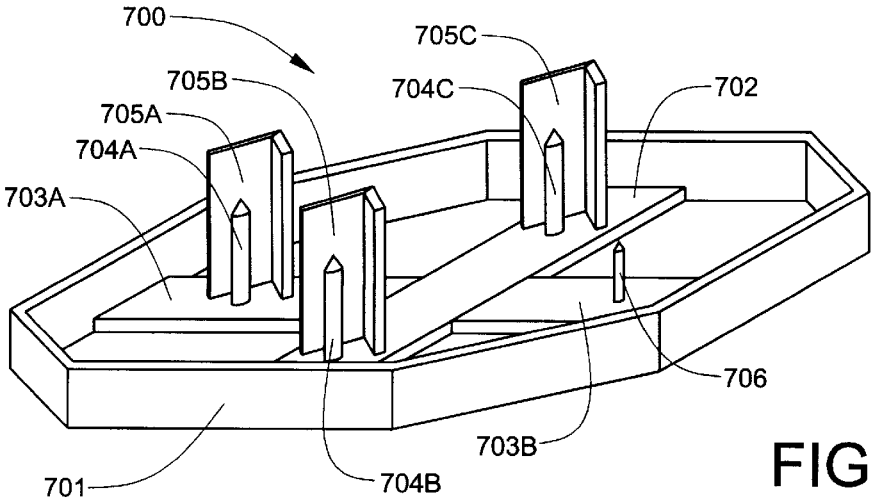
FIG. 7 is an isometric view of a stand for four new artificial palm trees.

Referring now to FIG. 7, a stand 700 is shown to which four large artificial palm trees and one small tree can be anchored. This stand 700 is designed to be used within cylindrical or conical pots. The stand is fabricated from mild steel plate. The stand is fabricated as an octagonal structure rather than as a circular structure in order to reduce manufacturing costs. The stand includes an octagonal rim 701, an X-shaped structure welded to the rim 701 formed by a full-width rectangular plate 702 and two smaller intersecting rectangular plates 703A and 703B. Each large tree attachment location has a locator pin and a support bracket 704A and 705A, 704B and 705B, 704C and 705C, respectively. The smaller tree attachment location requires only a locator pin 706.

Figure 8:
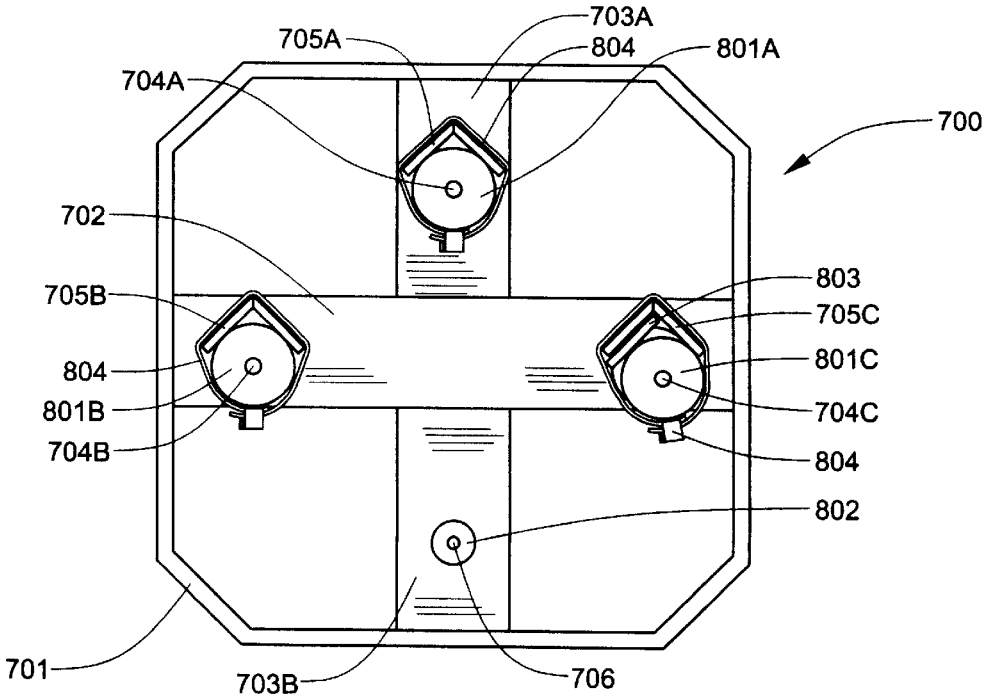
FIG. 8 is a top plan view of the stand of FIG. 7.

Referring now to FIG. 8, the top plan view of the stand of FIG. 7 shows the location of three large palm tree trunks 801A, 801B and 801C and a small palm tree trunk 802. The mounting of a large tree may be angled by bending the locator pin 704A, 704B, or 704C and by inserting a wedge 803 between the trunk and the support bracket 705A, 705B or 705C. Angled mounting of the smaller tree may be accomplished merely by bending locator pin 706. Each of the large tree trunks 801A, 801B and 801C is attached to its respective support bracket with a clamp 804.

Figure 9:
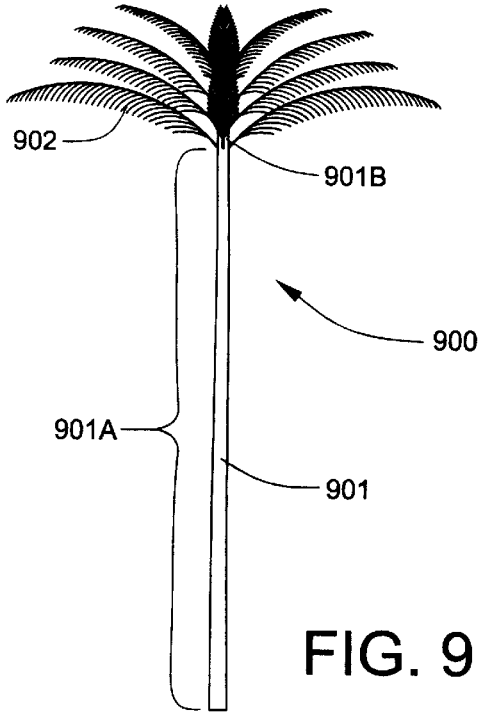
FIG. 9 is a side elevational view of a fully-assembled single-pole artificial palm tree.

In FIG. 9, a small artificial palm tree 900 fabricated in accordance with the present invention is shown. This tree is of a height that is not so large that the trunk and frond attachment head need not be disassemblable. The trunk and head portions 901A and 901B, respectively are formed from the same pole 901. During the assemble process. The head portion 901B drilled is with front attachment holes 301 which are (see FIG. 3) fitted with dowel pins 205. The trunk and head portions have been wrapped with palm matting 601 and the palm matting has been stapled to the pole. Fronds have either been inserted within the frond attachment holes in the pole 901, or in the holes 501 drilled within the dowel pins 205.

Figure 10:
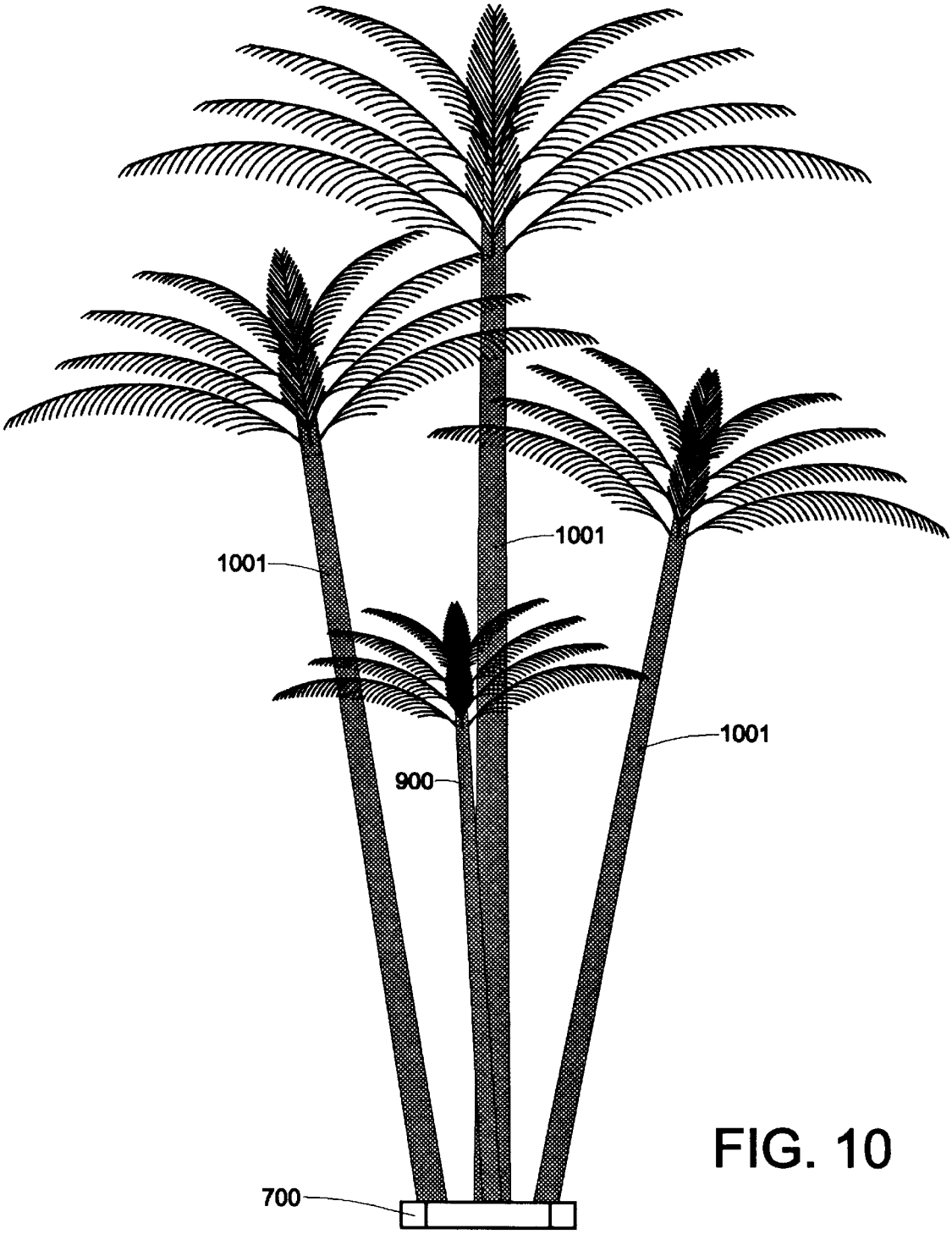
FIG. 10 is a side elevational view of four completely assembled artificial palm trees mounted on the stand of FIGS. 7 and 8.

Referring now to FIG. 10, an assembly of three large trees and a smaller tree are shown, all fabricated in accordance with the present invention. The trunk and frond attachment head portions of each tree are covered with palm matting 601, which has been stapled to the pole sections. Fronds of various sizes have been attached to the frond attachment head portions of each tree.

Although only several embodiments of the present invention have been disclosed herein, it will be obvious to those having ordinary skill in the art that changes and modifications may be made thereto without departing from the scope and spirit of the invention as hereinafter claimed.

What is claimed is:

1. An artificial palm tree comprising:

at least one pole segment for a trunk portion and a cylindrically shaped frond attachment head portion having upper and lower ends continuous with an outer cylindrical surface, said lower end coupleable to an uppermost end of said trunk portion, said frond attachment head portion having a plurality of frond attachment apertures therein at frond attachment locations, at least three of which are located on the upper end of said frond attachment head portion, the remainder of said frond attachment locations being located on said outer cylindrical surface, and grouped in tiers of three, each aperture of a tier being spaced from the other two apertures of the same tier by an angle of about 120 degrees, and the apertures of each tier being spaced from apertures of adjacent tiers by an angle of about sixty degrees;

a palm matting layer stapled to said trunk and frond attachment head portions; and an artificial palm frond having a central rib with an attachment end secured to said frond attachment head portion at each frond attachment location.

2. The artificial palm tree of claim 1, wherein multiple, interconnected pole segments are used to form the trunk portion and the frond attachment head portion of the tree.

3. The artificial palm tree of claim 2, wherein each of the pole segments is attached to at least one other pole segment with an axially-aligned doweling screw threaded at both ends.

4. The artificial palm tree of claim 1, wherein the apertures of all but the uppermost tier have of axes which make an angle of about 45 degrees to the axis of the cylindrical head portion.

5. The artificial palm tree of claim 1, wherein said trunk portion has a mounting aperture at the base of the trunk portion axially aligned thereto and wherein said artificial tree further comprises a stand for supporting said trunk and frond attachment head portions, said stand having at least one locator pin insertable within the mounting aperture.

6. The artificial palm tree of claim 5, wherein said stand includes a support bracket associated with said at least one locator pin, and said stand also includes a clamp associated with each support bracket with which said trunk portion may be secured to said support bracket.

7. The artificial palm tree of claim 6, which further comprises at least one wedge inserted between one plate of a support bracket and a trunk portion adjacent thereto, said wedge providing angular adjustment of the trunk portion from a plumb position.

8. An artificial palm tree comprising:

at least one pole segment for a trunk portion and a cylindrically shaped frond attachment head portion having upper and lower ends continuous with an outer cylindrical surface, said lower end coupleable to an uppermost end of said trunk portion, said frond attachment head portion having a plurality of frond attachment apertures therein at frond attachment locations, at least three of which are located on the upper end of said frond attachment head portion, the remainder of said frond attachment locations being located on said outer cylindrical surface;

one dowel pin inserted within each of said frond attachment apertures, each dowel pin having an axial bore;

a palm matting layer stapled to said trunk and frond attachment head portions; and an artificial palm frond having a central rib with an attachment end inserted in each axial bore.

9. The artificial palm tree of claim 8, wherein the exposed end of each dowel pin is wrapped with a layer of palm matting in order to smooth the transition between the dowel pin and the attachment end of the rib.

10. The artificial palm tree of claim 8, wherein the exposed end of each dowel pin is covered with a layer of peat moss in order to camouflage it.

11. An artificial palm tree comprising:

multiple pole segments for a trunk portion, each pole segment interconnectable to at least one other pole segment with an axially-aligned doweling screw threaded at both ends, a cylindrically shaped frond attachment head portion having upper and lower ends continuous with an outer cylindrical surface, said lower end coupleable to an uppermost end of said trunk portion, said frond attachment head portion having a plurality of frond attachment apertures therein at frond attachment locations, at least three of which are located on the upper end of said frond attachment head portion, the remainder of said frond attachment locations being located on said outer cylindrical surface;

a palm matting layer stapled to said trunk and frond attachment head portions; and an artificial palm frond having a central rib with an attachment end secured to said frond attachment head portion at each frond attachment location.

12. The artificial palm tree of claim 11, wherein said apertures are grouped in tiers of three, each aperture of a tier being spaced from the other two apertures of the same tier by an angle of about 120 degrees, and the apertures of each tier being spaced from apertures of adjacent tiers by an angle of about sixty degrees.

13. The artificial palm tree of claim 11, wherein the apertures of all but the uppermost tier have of axes which make an angle of about 45 degrees to the axis of the cylindrical head portion.

14. The artificial palm tree of claim 11, wherein said trunk portion has a mounting aperture at the base of the trunk portion axially aligned thereto and wherein said artificial tree further comprises a stand for supporting said trunk and frond attachment head portions, said stand having at least one locator pin insertable within the mounting aperture.

15. The artificial palm tree of claim 14, wherein said stand includes a right-angle support bracket having two perpendicular intersecting plates associated with said at least one locator pin, and said stand also includes a clamp associated with each support bracket with which said trunk portion may be secured to said support bracket.

16. The artificial palm tree of claim 15, which further comprises at least one wedge inserted between one plate of a support bracket and a trunk portion adjacent thereto, said wedge providing angular adjustment of the trunk portion from a plumb position.

17. The artificial palm tree of claim 11, which further comprises at least one dowel pin inserted within one of said frond attachment apertures, said dowel pin having an axial bore in which the attachment end of a rib of one of said palm fronds is inserted.

18. The artificial palm tree of claim 17, wherein the exposed end of each dowel pin is wrapped with a layer of palm matting in order to smooth the transition between the dowel pin and the attachment end of the rib.

19. The artificial palm tree of claim 17, wherein the exposed end of each dowel pin is covered with a layer of peat moss in order to camouflage it.

* * * * *